United States Patent [19]

Ii et al.

[11] Patent Number: 4,478,764

[45] Date of Patent: Oct. 23, 1984

[54] AIR VALVE TYPE CARBURETOR

[75] Inventors: Akira Ii, Toyoda; Toshio Morikawa, Okazaki; Hirosi Suwahara, Toyota, all of Japan

[73] Assignee: Toyota Jidoshi Kabushiki Kaisha, Aichi, Japan

[21] Appl. No.: 439,583

[22] Filed: Nov. 5, 1982

[30] Foreign Application Priority Data

Mar. 4, 1982 [JP] Japan ..... 57-33035

[51] Int. Cl.[3] ..... F02M 7/22

[52] U.S. Cl. ..... 261/50 A; 261/DIG. 67

[58] Field of Search ..... 261/50 A, DIG. 67

[56] References Cited

U.S. PATENT DOCUMENTS

| | | | |
|---|---|---|---|
| 3,198,498 | 8/1965 | Mennesson | 261/50 A |
| 3,294,377 | 12/1966 | Smith | 261/50 A |
| 3,628,773 | 12/1971 | Kehoe et al. | 261/50 A |
| 3,635,254 | 1/1972 | Mitchell | 261/50 A |
| 3,814,392 | 6/1974 | Boyd et al. | 261/DIG. 67 |
| 3,916,020 | 10/1975 | Malphettes et al. | 261/DIG. 67 |
| 3,935,290 | 1/1976 | Dickensheets et al. | 261/50 A |

FOREIGN PATENT DOCUMENTS

| | | | |
|---|---|---|---|
| 2307973 | 4/1976 | France | 261/50 A |

*Primary Examiner*—Tim Miles

*Attorney, Agent, or Firm*—Finnegan, Henderson, Farabow, Garrett & Dunner

[57] ABSTRACT

An air valve type carburetor of the kind in which a throttle valve is disposed in the downstream portion of a barrel interconnected to an engine via an intake manifold; a main nozzle is disposed upstream of the barrel and is connected to a jet of a float chamber; an air horn disposed on the barrel is connected to an air cleaner via an air connector; an air valve is disposed at the upper part of the main nozzle, faces at its tip the nozzle and is connected to the base end of a metering needle which is inserted into a through-hole of the air horn for free vertical movement therein; and a shield plate is fixed to the shank of the metering needle so as to prevent pressure pulsations inside the air connector from entering the through-hole and being applied to the surface of the fuel.

8 Claims, 5 Drawing Figures

FIG.2
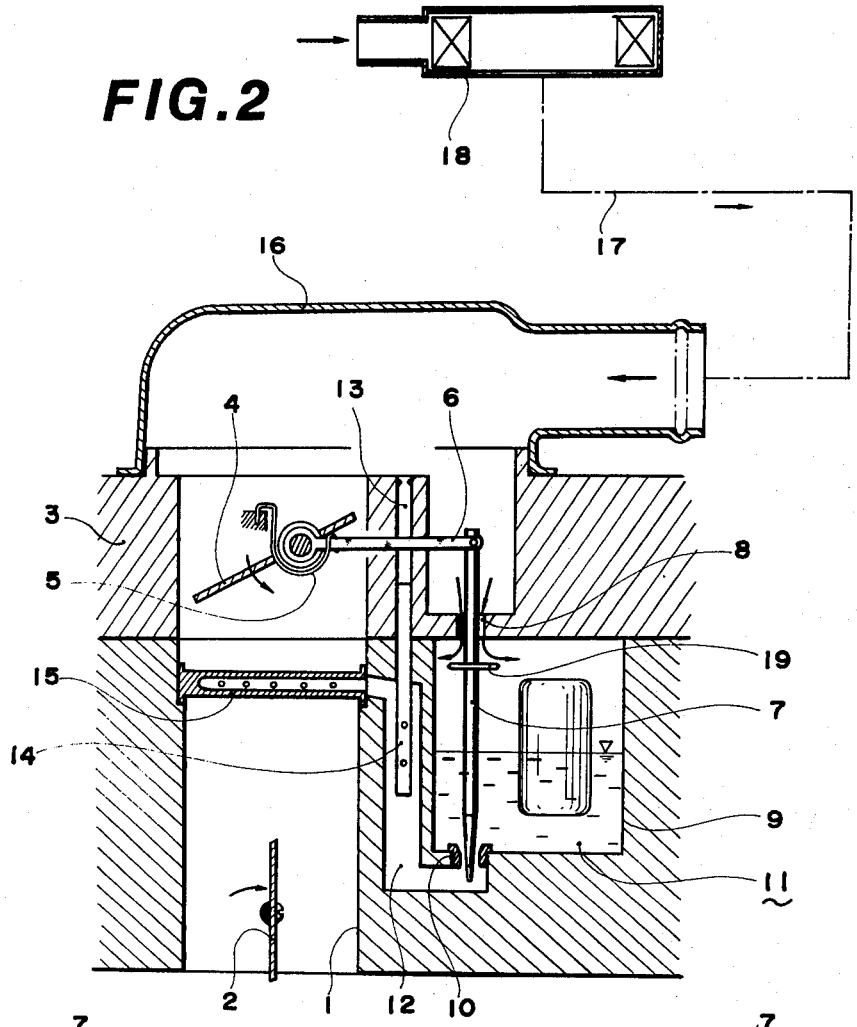
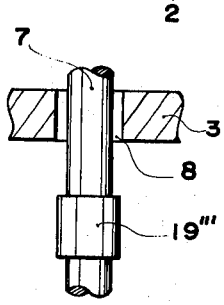
FIG.5
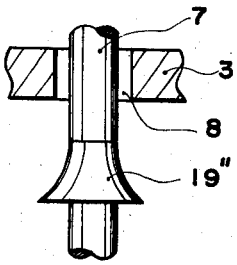
FIG.4
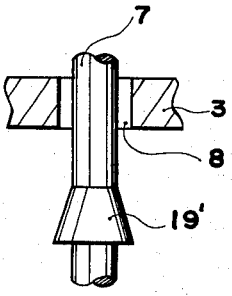
FIG.3

AIR VALVE TYPE CARBURETOR

BACKGROUND OF THE INVENTION (1) Field of the Invention

This invention is broadly concerned with the field of the technique of stabilizing an air-fuel ratio in the high load, high speed range of an air valve type carburetor of an engine for vehicles such as a car.

(2) Description of the Prior Art

As is well known in the art, a variety of carburetors are available for engines of cars or the like and they have both merits and demerits. Among them, a so-called air valve type carburetor has gained a wide application because it provides excellent high load, high speed performance.

The air valve type carburetor will be now outlined with reference to FIG. 1. A barrel 1 is interconnected to an engine, not shown, via an intake manifold. When a throttle valve 2 of this barrel 1 is fully open in the interlocking arrangement with a throttle valve on the primary side, not shown, and the engine operation changes to the high speed, high load operation, an air valve 4 of an air horn 3 gradually opens to a balanced state in accordance with an intake air quantity against the force of a return spring 5 so that a metering needle 7, which is pivotally supported by a pin at the tip of a link 6 interconnected to the air valve 4, is loosely raised inside a through-hole 8 of the air horn 3, expanding metering opening with respect to a jet 10 that is disposed in a float chamber 9. The fuel 11 thus metered is applied to a well 12 and is mixed and emulsified with bleed air by an emulsion pipe 14 connected to an air bleed 13. The mixture is discharged as a rich air-fuel mixture from a main nozzle 15 that is disposed between the throttle valve 2 and the air valve 4.

An air connector 16, which is disposed on the air horn 3 as shown in the drawing, is connected, via a duct 17, to an air cleaner 18 disposed at a predetermined position inside an engine room. According to this arrangement, the air sucked into the air connecter 16 is applied from the air valve 4 to the barrel 1 and is also communicated with the float chamber 9 via the through-hole 8 of the metering needle 7.

Accordingly, the intake air pressure changes with the reciprocating revolution of the engine. Intake pulsation occurs especially strongly inside the carburetor, disposed separately from the air cleaner, during the high load, high speed operation of the engine.

Intake pulsation also affects the float chamber also from the through-hole 8 as shown in FIG. 1 in such a manner as to push down the surface of the fuel oil immediately below the through-hole 8 in the conelike form. If this phenomenon proceeds, the jet 10 sucks the air and the air-fuel mixture becomes excessively lean, deteriorating engine drivability. In such a case, the excellent high load, high speed performance inherent to the air valve type carburetor can no longer be obtained.

SUMMARY OF THE INVENTION

The present invention has its technical object in solving the problem of the drop of the fuel oil surface resulting from intake pulsation of the float jet in the high load, high speed operation range of the conventional air valve type carburetor described above. In other words, the present invention provides an air valve type carburetor in which a shield plate is fixed to the metering needle which is in turn inserted loosely into the through-hole of the air horn. The air valve type carburetor of the present invention prevents the pressure change resulting from intake pulsation from affecting the floating chamber and can be satisfactorily applied to a variety of carburetors for various vehicles such as cars.

BRIEF DESCRIPTION OF THE DRAWINGS

FIG. 2 is a sectional view of the air valve type carburetor in accordance with one embodiment of the present invention;

FIG. 3 is an enlarged schematic view of the portion A shown in FIG. 2;

FIG. 4 is a schematic view of the air valve type carburetor in accordance with another embodiment of the present invention; and FIG. 5 is a schematic view of the air valve type carburetor in accordance with still another embodiment of the present invention.

DESCRIPTION OF THE PREFERRED EMBODIMENTS

Figure 1:
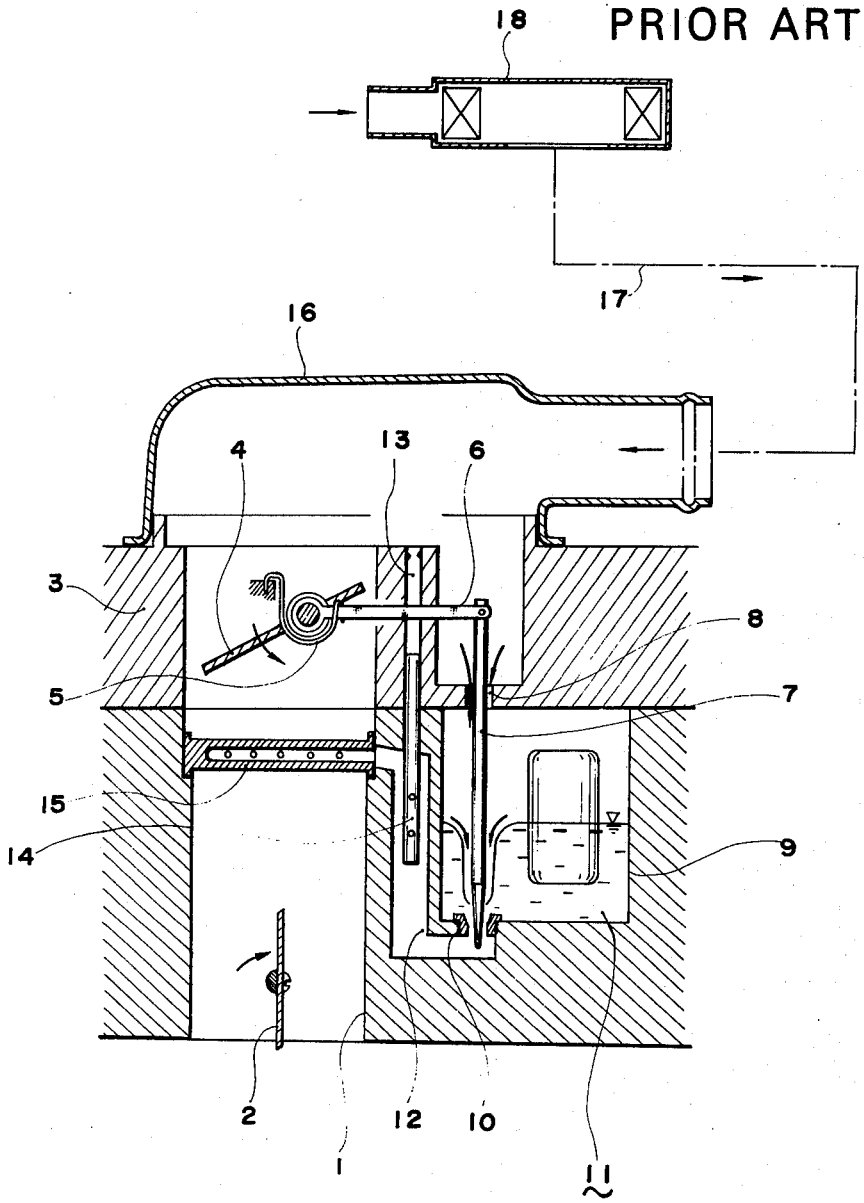
FIG.1 PRIOR ART
FIG. 1 is a schematic view showing the principal portions of the air valve type carburetor in accordance with the prior art.

In the embodiment shown in FIGS. 2 and 3, the barrel 1 is interconnected to the engine via an intake manifold not shown. A throttle valve 2 is disposed downstream of the barrel 1 so as to operate in the mechanical interlocking arrangement with another throttle valve on the primary side which is not shown. An air horn 3 is fitted onto the barrel 1. An air valve 4 is pivotally supported by the air horn 3 and is urged in the returning direction by a spring 5. The tip of a side link 6, which is integral with the air valve 4, is pivotally supported by a pin at the base end of a metering needle 7.

The metering needle 7 is placed inside a float chamber 9 through a through-hole 8 of the air horn 3 and faces the tip of a jet 10 of the float chamber 9 so as to meter the fuel 11 and to apply the fuel to a well 12. The fuel inside the well 12 is mixed with bleed air metered by an emulsion hole of an emulsion pipe connected to an air bleed 13, and is discharged from a main nozzle 15.

An air connector 16 is mounted onto the air horn 3 and is connected to an air cleaner 18 at a predetermined position via a duct 17. The upper portion each of the air valve 4, air bleed 13 and through-hole is connected to the inside of the air connecter 16.

The construction described above is substantially the same as the construction of the conventional embodiment shown in FIG. 1.

In accordance with the present invention, a shield plate 19 is fixed to the metering needle 7 at right angles by an industrial adhesive or other suitable means. The shield plate is made of a lightweight material such as foamed styrol and has a disc-like shape whose diameter is considerably greater than that of the through-hole 8. The shield plate is fixed at an intermediate part of the metering needle 7 to be inserted into the though-hole inside the air connecter 16 such as at a set position in the proximity of the through-hole 8 from its lower end under the state in which the air valve 4 is fully open so as to correspond to the full open state of the throttle valve 2.

The proximate quantity with respect to the through-hole 8 is such that the air flow from the through-hole 8 can be deflected sideways by the shield plate 19 as shown in the drawing.

In accordance with the construction described above, when the car changes from the normal driving state to the high load or high speed operation and the acceleration pedal is pressed, the throttle valve 2 on the secondary side is fully opened in the interlocking arrangement with the operation of the throttle valve on the primary side and the air valve 4 gradually opens in accordance with the intake air quantity against the force of the return spring 5 so that the metering needle 7 rises via the link 6, opens the jet 10, and meters and applies the fuel 11 to the well 12. The fuel is then mixed with the bleed air from the emulsion hole and is discharged as a rich air-fuel mixture from the main nozzle 15, providing high torque to the engine.

In the interim, the intake air from the air cleaner causes intake pulsation inside the air connecter 16, as described already. However, since the disc-like shield plate 19 is fixed to the metering needle 7 at right angles at its loose elevating portion with respect to the through-hole 8, the intake air, which changes due to pulsation, enters the float chamber 9 from the through-hole 8. Accordingly, even when a changing pressure is applied, it is substantially absorbed and does not act upon the float chamber 9, so that the oil level of the fuel 11 is kept flat without being pressed. Hence, only the fuel 11 is metered and applied from the jet 10 to the well 12 without any intake air. Thus, high torque is generated at the set rich air-fuel ratio and satisfactory high load high speed drivability can be secured.

Even if oscillation or the like occurs during driving, the shield plate 19 has less moment of force because it is made of a light-weight material and does not cause the metering needle 7 to displace sideways.

In the embodiment shown in FIG. 3, the shield plate 19' is straight tapered with respect to the through-hole 8 so that the incoming pulsating air from the through-hole 8 is more likely to displace sideways.

In the embodiment shown in FIG. 4, the shield plate has a concave shape so as to provide more effective effects than the embodiment shown in FIG. 3. In still another embodiment of the invention shown in FIG. 5, the diameter of the through-hole 8 is reduced so as to facilitate machining.

Needless to say, the present invention is not particularly limited to the embodiments described above but can be worked in various other embodiments. For example, the shield plate may be disposed at upper and lower two stages or may be equipped at its peripheral portion with steps as a rectifying rib. The shield plate may also be made of a light-weight material.

As described in the foregoing, in the air valve type carburetor, although the air cone having the through-hole, into which the metering needle connected to the air valve is inserted, is open to the air connector to which the air cleaner is connected, the present invention disposes the shield plate having a diameter greater or smaller than the diameter of the through-hole at a predetermining position of the metering needle loosely moving up and down inside the through-hole so as to be right angles to the shank of the metering needle, so as to interrupt the air flow between the air connector and the float chamber. Accordingly, even when intake pulsation occurs inside the air connecter during high load high speed operation, the pressure change resulting from pulsation does not act upon the float chamber so that push force is not applied to the surface of the fuel oil inside the float chamber. This arrangement eventually facilitates the air intake from the jet and provides high torque at the rich air-fuel ratio as was originally designed. Hence, excellent drivability can be obtained.

Since the shield plate is made of a light-weight material, it creates little side displacement of the metering needle when the needle moves up and down. The shield plate neither results in the increase in the weight of the needle nor in the deterioration of the fuel consumption.

In accordance with the present invention, further, the shield plate may be merely fixed to the metering needle so that the conventional embodiment can be employed as such. In producing the carburetor, an additional step is limited and hence, the increase in the production cost is negligible. Since the construction is simple but has high strength, the apparatus of the invention has less trouble, does not require maintenance but has high durability.

What is claimed is:

1. In an air valve type carburetor of the kind in which a barrel provided with a throttle valve has a main nozzle interacting with a jet disposed inside the float chamber of a fuel bowl and an air valve positioned in an air horn at the upper part of said barrel is interconnected by a link to the upper end of a metering needle inserted into a through-hole of said air horn for free vertical movement therein and facing said jet at the lower end of the needle, said through-hole having access to an air cleaner through an air connector, the improvement wherein a shield plate is rigidly fixed to the shank of said metering needle at a position in said fuel bowl proximate said through-hole when said air valve is fully open.

2. The air valve type carburetor of claim 1 wherein said shield plate is made of light-weight material for creating little side displacement of said metering needle when the needle moves up and down.

3. The air valve type carburetor of claim 2 wherein said light-weight material is foamed styrol.

4. The air valve type carburetor as defined in claim 1 wherein said shield plate is tapered with respect to said through-hole.

5. The air valve type carburetor of claim 4 wherein the tapered portion of said shield plate is concavely arcuate.

6. The air valve type carburetor of claim 4 wherein said shield plate is disc-shaped.

7. The air valve type carburetor of claim 4 wherein said shield plate is made of light-weight material for creating little side displacement of said metering needle when the needle moves up and down.

8. The air valve type carburetor of claim 7 wherein said light-weight material is foamed styrol.

* * * * *